US011756755B2

(12) United States Patent
Huang et al.

(10) Patent No.: US 11,756,755 B2
(45) Date of Patent: Sep. 12, 2023

(54) DUAL ENERGY STORAGE OPERATING MECHANISM OF ISOLATING SWITCH

(71) Applicant: Zhejiang Benyi Electrical Co., Ltd., Wenzhou (CN)

(72) Inventors: Jianyong Huang, Wenzhou (CN); Renyuan Wang, Wenzhou (CN); Laiyuan Yu, Wenzhou (CN); Shijun Sun, Wenzhou (CN)

(73) Assignee: ZHEJIANG BENYI ELECTRICAL CO., LTD., Wenzhou (CN)

( * ) Notice: Subject to any disclaimer, the term of this patent is extended or adjusted under 35 U.S.C. 154(b) by 507 days.

(21) Appl. No.: 16/978,181

(22) PCT Filed: Jul. 12, 2019

(86) PCT No.: PCT/CN2019/095821
§ 371 (c)(1),
(2) Date: Sep. 3, 2020

(87) PCT Pub. No.: WO2020/252832
PCT Pub. Date: Dec. 24, 2020

(65) Prior Publication Data

US 2023/0115069 A1 Apr. 13, 2023

(30) Foreign Application Priority Data

Jun. 17, 2019 (CN) ..... 201910521343.5

(51) Int. Cl.
*H01H 31/02* (2006.01)
*H01H 19/24* (2006.01)
(Continued)

(52) U.S. Cl.
CPC ..... *H01H 31/026* (2013.01); *H01H 3/3031* (2013.01); *H01H 5/10* (2013.01); *H01H 5/16* (2013.01); *H01H 19/24* (2013.01)

(58) Field of Classification Search
CPC ..... H01H 31/026; H01H 3/3031; H01H 5/10; H01H 5/16; H01H 3/00; H01H 3/02; H01H 3/22
USPC ..... 200/19.13, 19.18, 19.2-19.22, 329, 400, 200/401, 500
See application file for complete search history.

(56) References Cited

U.S. PATENT DOCUMENTS 5,889,250 A * 3/1999 Castonguay ..... H01H 3/3021 200/50.01
7,696,447 B2* 4/2010 Chen et al. ..... H01H 3/3005 335/171
(Continued)

FOREIGN PATENT DOCUMENTS

CN 106128840 A * 11/2016 ..... H01H 31/02

*Primary Examiner* — Edwin A. Leon
*Assistant Examiner* — Iman Malakooti
(74) *Attorney, Agent, or Firm* — Leong C. Lei

(57) ABSTRACT

A dual energy storage operating mechanism of an isolating switch is provided. A first energy storage mechanism and a second energy storage mechanism are provided between an input wheel and a housing and between the input wheel and an output wheel or a first output shaft, respectively. The output wheel is provided with a limiting mechanism. The limiting mechanism forms a locking effect on the output wheel when the first energy storage mechanism stores energy, thereby enabling the second energy storage mechanism to store energy at the same time. When the first energy storage mechanism starts to release energy, the locking effect of the limiting mechanism is released, so that the output wheel and the first output shaft can rotate, and the first energy storage mechanism and the second energy storage mechanism release energy at the same time, forming a dual energy storage boosting effect.

15 Claims, 16 Drawing Sheets

(51) Int. Cl.

| | |
|---|---|
| ***H01H 5/16*** | (2006.01) |
| ***H01H 5/10*** | (2006.01) |
| ***H01H 3/30*** | (2006.01) |

(56) References Cited

U.S. PATENT DOCUMENTS 9,443,668 B2* 9/2016 Zhang et al. ..... F16D 7/024

* cited by examiner

DUAL ENERGY STORAGE OPERATING MECHANISM OF ISOLATING SWITCH

BACKGROUND OF THE INVENTION

1. Field of the Invention

The present invention relates to a dual energy storage operating mechanism of an isolating switch.

2. Description of the Prior Art

As to an isolating switch, when in a switching-off position, an insulation distance is defined between contacts, meeting the requirement, and a disconnection mark is provided; when in a switching-on position, it can bear the current under normal circuit conditions and the current under abnormal conditions within a specified time.

The operating mechanism of the isolating switch is generally provided with an energy storage mechanism, such as a spring. The energy storage mechanism is configured to store energy and release energy instantaneously for connecting and disconnecting the contact structure instantaneously, so that the connection time when in the switching-on position and the disconnection time when in the switching-off position are independent of the operating speed of the operating handle, thereby improving various electrical and mechanical performances. In general, the operating mechanism of the isolating switch is provided with only one energy storage mechanism, such as an operating device of an isolating switch disclosed in China Patent Publication No. CN201610764579.8. The energy storage mechanism includes two springs arranged between a linking disc and a housing. This structure has some problems. When in the switching-off position, the rotation angle of the output shaft is driven by the energy released by the energy storage mechanism. The energy released by the energy storage mechanism is limited so the rotation angle is limited. As a result, the rotation angle of the output shaft cannot meet the expectations, that is, the opening may be insufficient when in the switching-off position.

SUMMARY OF THE INVENTION

The primary object of the present invention is to overcome the shortcomings and deficiencies of the prior art and to provide a dual energy storage operating mechanism of an isolating switch.

The technical solutions adopted by the present invention are described below. A dual energy storage operating mechanism of an isolating switch comprises a housing. A first input shaft and a first output shaft are rotatably disposed in the housing. At least one end of the first output shaft extends out of the housing as an output end linked with the isolating switch. At least one end of the first input shaft extends out of the housing as an operating end. An input wheel, an output wheel and a limiting mechanism are provided in the housing. The input wheel is coaxial with the first output shaft. The output wheel is coaxial with the first output shaft and linked circumferentially. The limiting mechanism has at least one elastic portion and is locked circumferentially. The output wheel has a first limiting portion and a linking groove. The limiting mechanism has a second limiting portion and a first pushing portion with a pushing slope. The input wheel includes a linking member partially located in the linking groove and a second pushing portion that cooperates with the first pushing portion. Two ends of the linking groove are formed with linking surfaces for mating with the linking member. The first input shaft drives the input wheel to rotate in at least part of a rotation path of the first input shaft. The second pushing portion interacts with the elastic portion of the limiting mechanism. In a rotation path of the input wheel, the second pushing portion is in contact with the pushing slope so that the limiting mechanism has a first position where the second limiting portion is engaged with the first limiting portion for the output wheel to be locked circumferentially and a second position where the second limiting portion is disengaged from the first limiting portion for the output wheel to be unlocked in a rotatable state.

A first energy storage mechanism is provided between the input wheel and the housing.

A second energy storage mechanism is provided between the input wheel and the output wheel or the first output shaft.

In the rotation path of the first input shaft from a switching-on position to a switching-off position, the first energy storage mechanism has an energy storage state and an energy release state. When the first energy storage mechanism is in the energy storage state, the linking member slides in the linking groove, the limiting mechanism is in the first position, and the second energy storage mechanism is in an energy storage state. When the first energy storage mechanism is in the energy release state, the linking member abuts against the linking surface, the limiting mechanism is in the second position, and the second energy storage mechanism is in an energy release state.

The limiting mechanism is disposed between the output wheel and an inner wall of the housing.

The limiting mechanism further has a retaining portion. The second limiting portion, the first pushing portion and the retaining portion are connected in sequence. The retaining portion is connected to the inner wall of the housing. The first limiting portion is a raised stepped portion. The second limiting portion abuts against the first limiting portion. The first pushing portion is obliquely disposed between the inner wall of the housing and the output wheel. The first pushing portion is made of an elastic material.

The limiting mechanism includes two retaining portions that are arranged symmetrically relative to an axis of the first output shaft. Two sides of the retaining portions extend outwardly and obliquely toward the output wheel to form two arc-shaped first pushing portions. Each of the first pushing portions protrudes close to an outer end of the output wheel to form the second limiting portion. The input wheel is provided with two second pushing portions that are arranged symmetrically relative to the axis. The output wheel is provided with two first limiting portions that are arranged symmetrically relative to the axis.

The first limiting portion has an inclined guide surface. The inclined guide surface is configured to form a guide effect on the second limiting portion along the output wheel in a direction from the switching-off position to the switching-on position.

The inner wall of the housing is provided with a limiting recess corresponding to the retaining portion. The retaining portion is engaged in the limiting recess.

The limiting mechanism is an annular elastic plate integrally formed of a metal material.

The second pushing portion is an end of the linking member. The linking member passes through the linking groove, and the end of the linking member keeps in contact with the pushing slope in the rotation path of the input wheel.

The second energy storage mechanism is a spring. Two ends of the spring abut against the linking member and the output wheel, respectively.

The output wheel has an annular groove and a first limiting groove communicating with the annular groove. The second energy storage mechanism is disposed in the annular groove. One end of the second energy storage mechanism is secured in the first limiting groove, and another end of the second energy storage mechanism is secured in a second limiting groove to cooperate with the linking member.

The first energy storage mechanism is a spring. Two ends of the spring are connected to the input wheel and the housing, respectively.

The first input shaft is provided with a coaxial first gear that is linked circumferentially. The input wheel is provided with a coaxial second gear that is linked circumferentially. The first gear is perpendicular to the second gear. A transmission mechanism is provided between the first gear and the second gear. The transmission mechanism has first teeth meshing with the first gear and second teeth meshing with the second gear. The transmission mechanism enables the second gear to rotate in at least part of a rotation path of the first gear.

The transmission mechanism includes a first rack and a second rack. The second rack is provided with a first slide groove corresponding to the first rack. The first rack is located in the first slide groove to slide linearly and cooperate with the second rack. The first teeth are disposed on the first rack. The second teeth are disposed on the second rack. Two ends of the first slide groove are provided with stoppers for blocking the first rack.

The inner wall of the housing is provided with a second slide groove corresponding to the transmission mechanism. The transmission mechanism is located in the second slide groove to slide linearly in the housing.

A metal elastic sheet is embedded in the second slide groove under the transmission mechanism. The metal sheet arches to provide a pushing force to the transmission mechanism toward the first gear.

The beneficial effects of the present invention are as described below.

The first energy storage mechanism and the second energy storage mechanism are provided between the input wheel and the housing and between the input wheel and the output wheel or the first output shaft, respectively. The output wheel is provided with the limiting mechanism. The limiting mechanism forms a locking effect on the output wheel when the first energy storage mechanism stores energy, thereby enabling the second energy storage mechanism to store energy at the same time. When the first energy storage mechanism starts to release energy, the locking effect of the limiting mechanism is released, so that the output wheel and the first output shaft can rotate, and the first energy storage mechanism and the second energy storage mechanism release energy at the same time, forming a dual energy storage boosting effect. The rotation angle of the first output shaft is greater, which improves the electrical and mechanical performances of the isolating switch.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE PREFERRED EMBODIMENTS

In order to make the objectives, technical solutions and advantages of the present invention clearer, the present invention will be described in further detail below with reference to the accompanying drawings.

It should be noted that all the terms "first" and "second" in the embodiments of the present invention may be used herein to describe various elements or components. These terms are used to distinguish one element or component from another element or component. These elements or components should not be limited by these terms. Subsequent embodiments will not describe them one by one.

Direction and position terms mentioned in the present invention, such as "upper," "lower," "front," "rear," "left," "right," "inner," "outer," "top," "bottom," "side," and the like, are only the directions or positions with reference to the drawings. Therefore, the terms of direction and position are used to illustrate and understand the present invention, rather than to limit the protection scope of the present invention.

Figure 1:
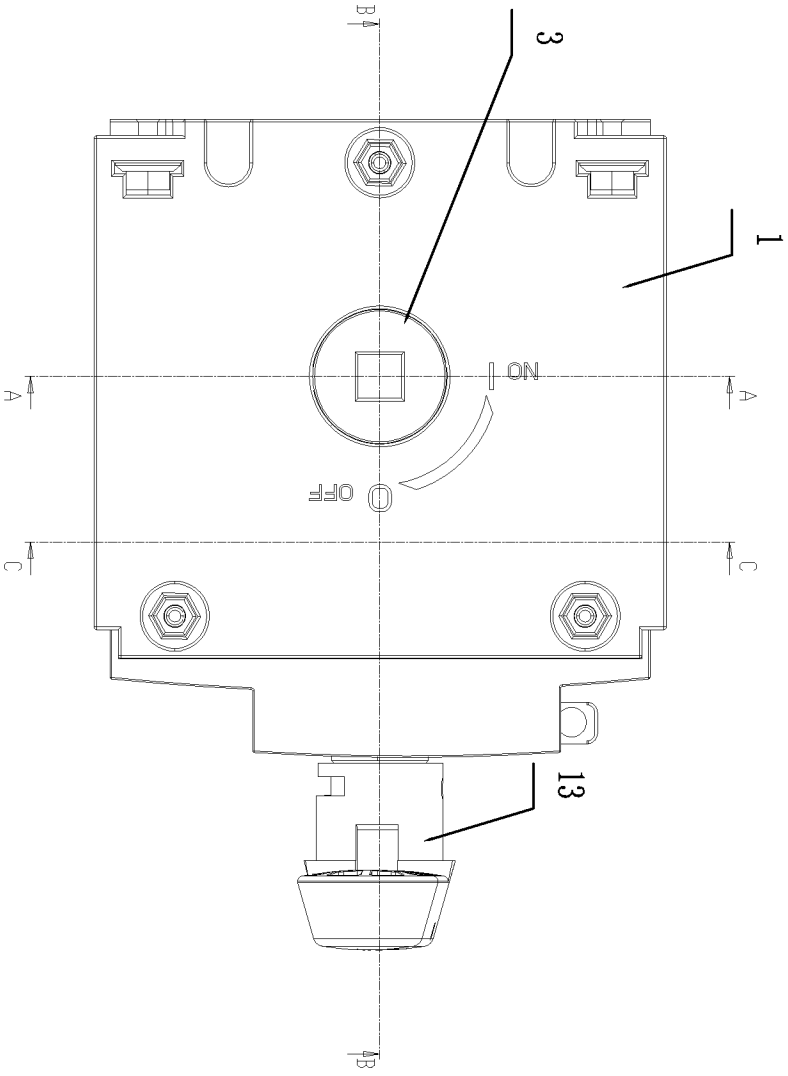
FIG. 1 is a schematic view of the operating mechanism.
Figure 2:
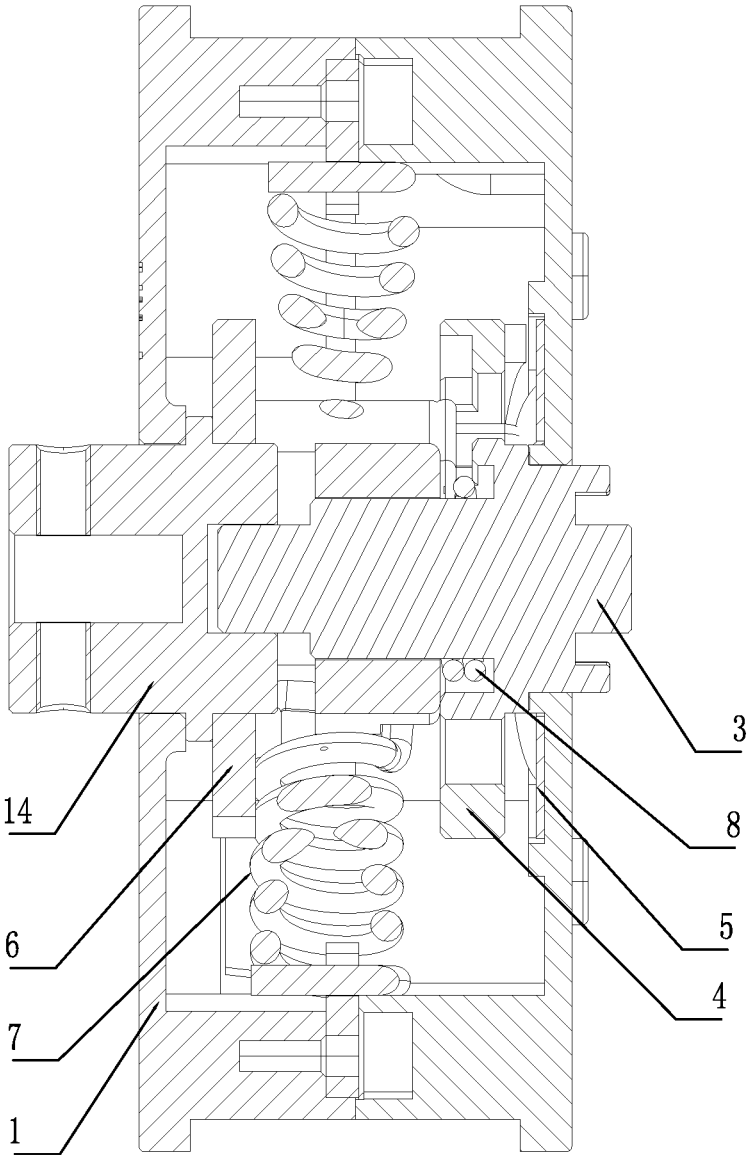
FIG. 2 is a sectional view taken along line A-A of FIG. 1.
Figure 3:
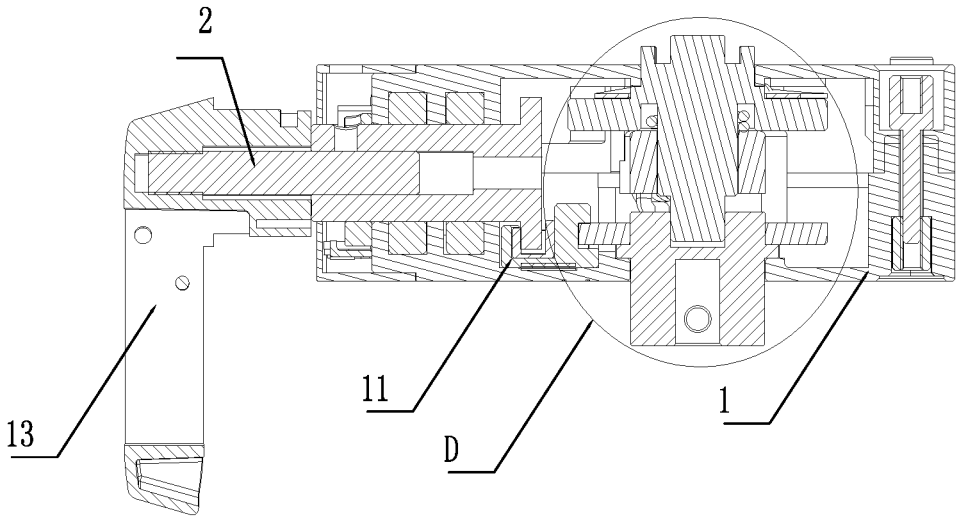
FIG. 3 is a sectional view taken along line B-B of FIG. 1.
Figure 4:
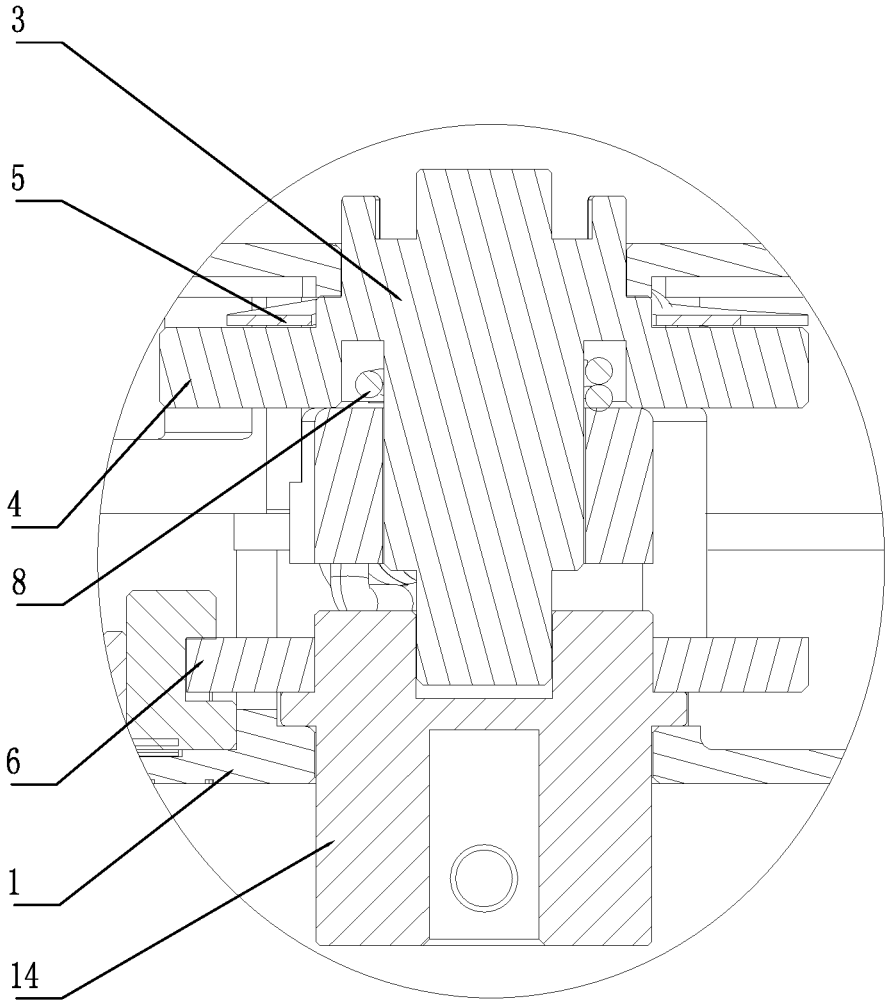
FIG. 4 is an enlarged view of circle D in FIG. 3.

As shown in FIGS. 1-3, a dual energy storage operating mechanism of an isolating switch comprises a housing 1. A first input shaft 2 and a first output shaft 3 are rotatably disposed in the housing 1. At least one end of the first output shaft 3 extends out of the housing 1 as an output end linked with the isolating switch. At least one end of the first input shaft 2 extends out of the housing 1 as an operating end. An input wheel 6, an output wheel 4 and a limiting mechanism 5 are provided in the housing 1. The input wheel 6 is coaxial with the first output shaft 3. The output wheel 4 is coaxial with the first output shaft 3 and linked circumferentially. The limiting mechanism 5 has at least one elastic portion and is locked circumferentially. The output wheel 4 has a first limiting portion 401 and a linking groove 402. The limiting mechanism 5 has a second limiting portion 501 and a first pushing portion 502 with a pushing slope 506. The input wheel 6 includes a linking member 601 partially located in the linking groove 402 and a second pushing portion 602 that cooperates with the first pushing portion 502. Two ends of the linking groove 402 are formed with linking surfaces 403 for mating with the linking member 601. The first input shaft 2 drives the input wheel 6 to rotate in at least part of the rotation path of the first input shaft 2. The second pushing portion 602 interacts with the elastic portion of the limiting mechanism 5. In the rotation path of the input wheel 6, the second pushing portion 602 is always in contact with the pushing slope 506, so that the limiting mechanism 5 has a first position where the second limiting portion 501 is engaged with the first limiting portion 401 for the output wheel 4 to be locked circumferentially and a second position where the second limiting portion 501 is disengaged from the first limiting portion 401 for the output wheel 4 to be unlocked in a rotatable state.

A first energy storage mechanism 7 is provided between the input wheel 6 and the housing 1.

A second energy storage mechanism 8 is provided between the input wheel 6 and the output wheel 4 or the first output shaft 3.

In the rotation path of the first input shaft 2 from a switching-on position to a switching-off position, the first energy storage mechanism 7 has an energy storage state and an energy release state. When the first energy storage mechanism 7 is in the energy storage state, the linking member 601 slides in the linking groove 402, the limiting mechanism 5 is in the first position, and the second energy storage mechanism 8 is in an energy storage state. When the first energy storage mechanism 7 is in the energy release state, the linking member 601 abuts against the linking surface 403, the limiting mechanism 5 is in the second position, and the second energy storage mechanism 8 is in an energy release state.

The first energy storage mechanism and the second energy storage mechanism are provided between the input wheel and the housing and between the input wheel and the output wheel or the first output shaft, respectively. The output wheel is provided with the limiting mechanism. The limiting mechanism forms a locking effect on the output wheel when the first energy storage mechanism stores energy, thereby enabling the second energy storage mechanism to store energy at the same time. When the first energy storage mechanism starts to release energy, the locking effect of the limiting mechanism is released, so that the output wheel and the first output shaft can rotate, and the first energy storage mechanism and the second energy storage mechanism release energy at the same time, forming a dual energy storage boosting effect. The rotation angle of the first output shaft is greater, which improves the electrical and mechanical performances of the isolating switch.

Figure 5:
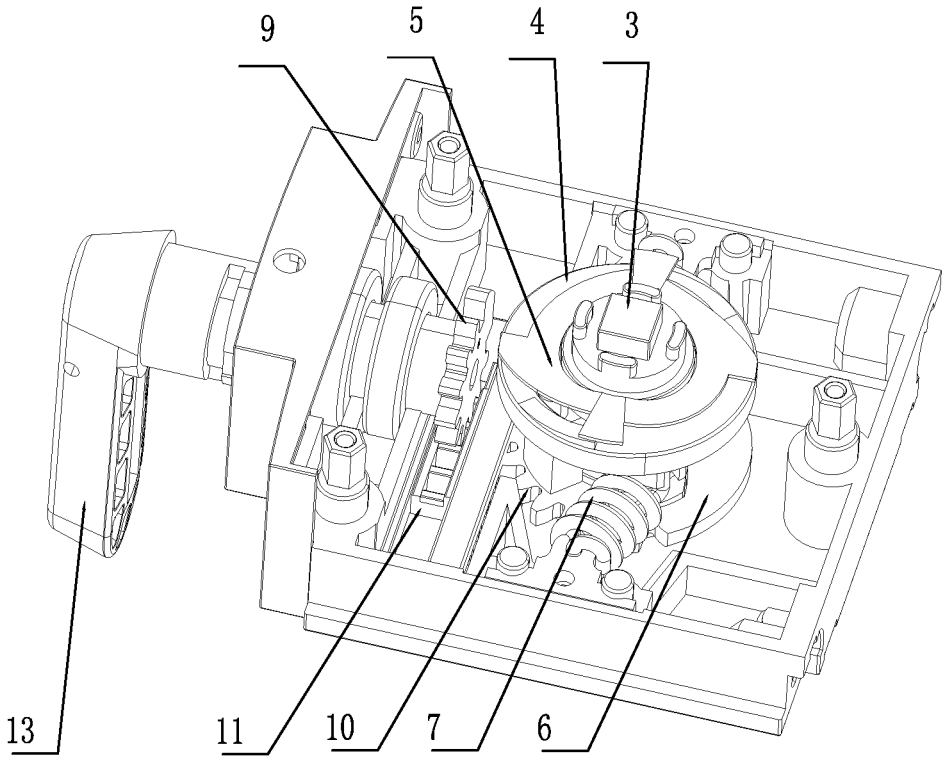
FIG. 5 is a schematic view showing the internal structure of the operating mechanism.
Figure 6:
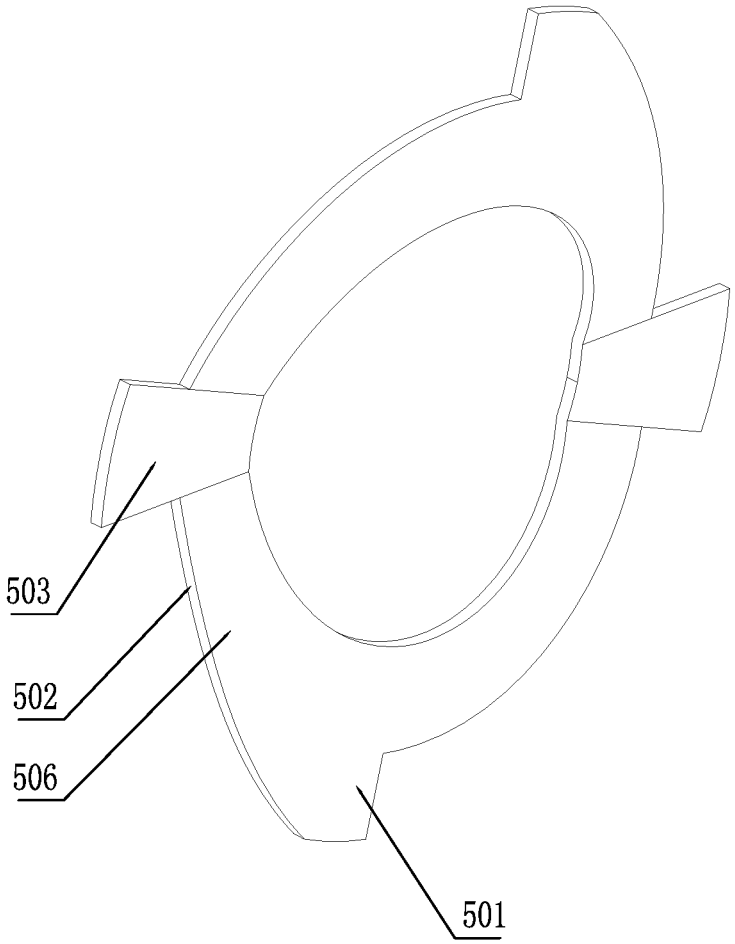
FIG. 6 is a schematic view of the limiting mechanism.
Figure 7:
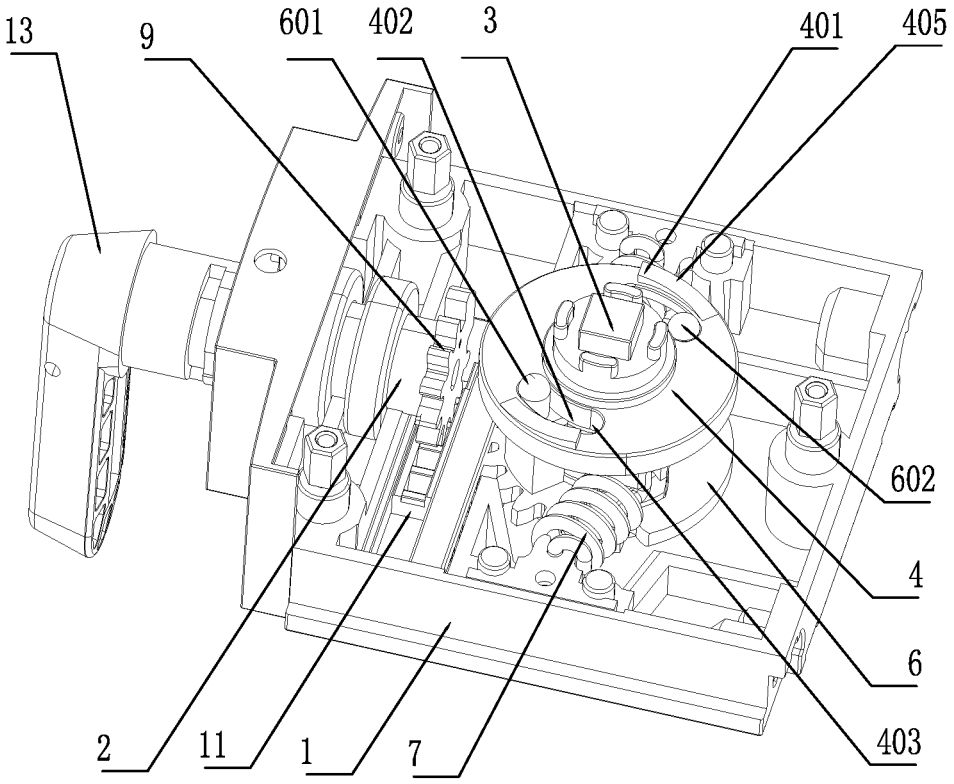
FIG. 7 is a schematic view of FIG. 5, without the limiting mechanism.
Figure 8:
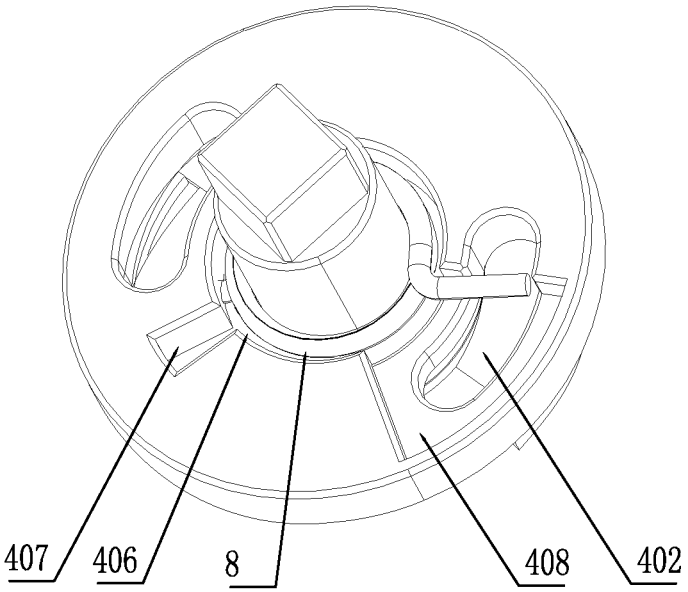
FIG. 8 is a schematic view showing the connection of the second energy storage mechanism and the output wheel.
Figure 9:
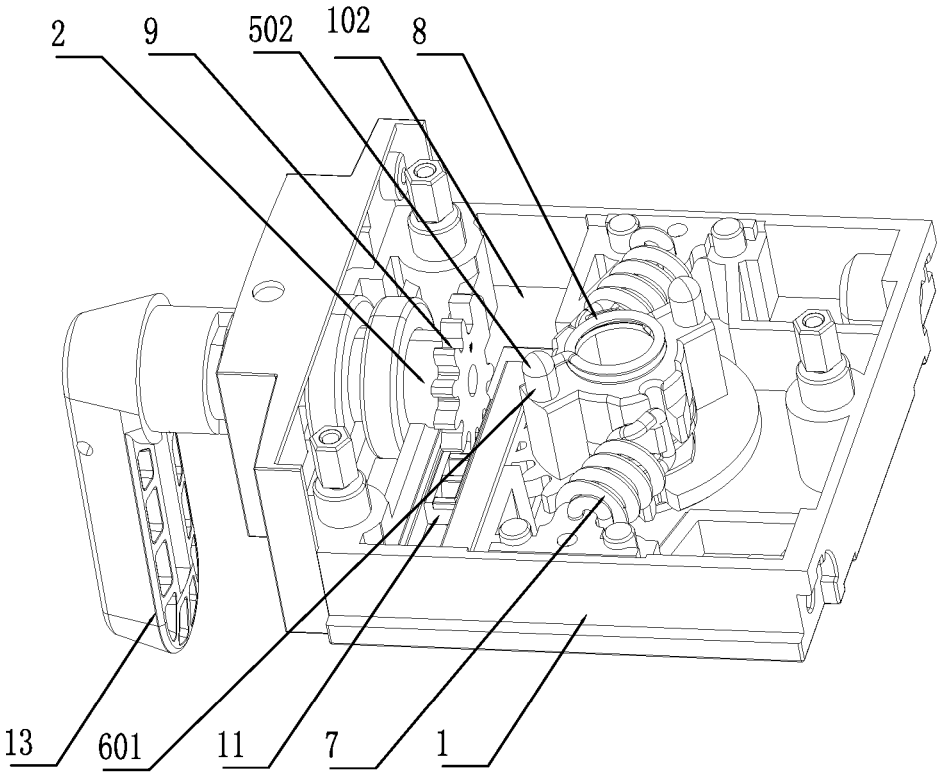
FIG. 9 is a schematic view of the operating mechanism, without the limiting mechanism, the output wheel and the first output shaft.
Figure 10:
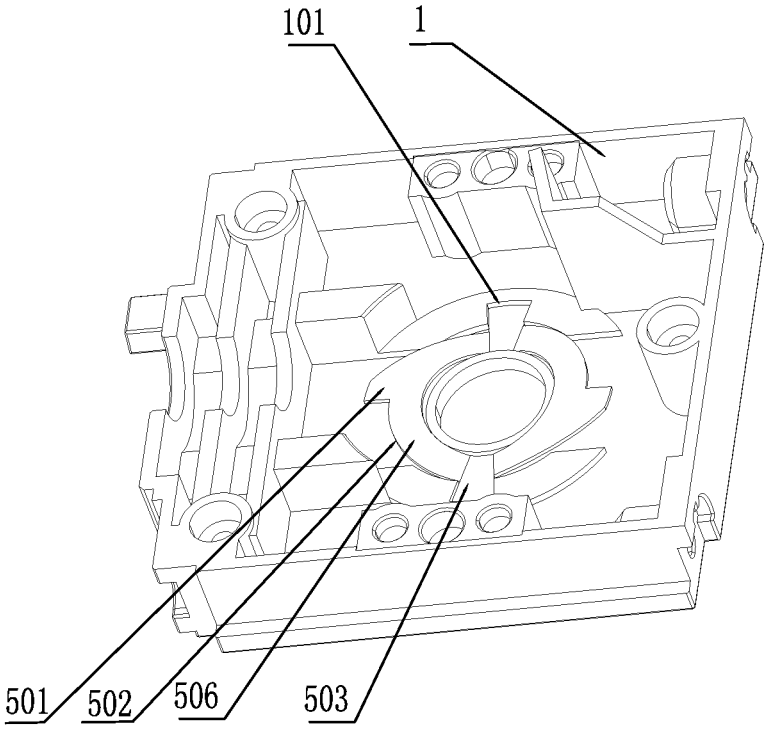
FIG. 10 is a schematic view showing the connection of the limiting mechanism and the housing.

As shown in FIGS. 5-7, the limiting mechanism 5 is disposed between the output wheel 4 and the inner wall of the housing 1. The limiting mechanism 5 further has a retaining portion 503. The second limiting portion 501, the first pushing portion 502 and the retaining portion 503 are connected in sequence. The retaining portion 503 is connected to the inner wall of the housing 1. The first limiting portion 401 is a raised stepped portion. The second limiting portion 501 abuts against the first limiting portion 401. The first pushing portion 502 is obliquely disposed between the inner wall of the housing 1 and the output wheel 4. The first pushing portion 502 is made of an elastic material.

The limiting mechanism 5 includes two retaining portions 503 that are arranged symmetrically relative to the axis of the first output shaft 3. Two sides of the retaining portions 503 extend outwardly and obliquely toward the output wheel 4 to form two arc-shaped first pushing portions 502. Each of the first pushing portions 502 protrudes close to the outer end of the output wheel 4 to form the second limiting portion 501. The input wheel 6 is provided with two second pushing portions 602 that are arranged symmetrically relative to the axis. The output wheel 4 is provided with two first limiting portions 401 that are arranged symmetrically relative to the axis.

As shown in FIG. 6, the limiting mechanism 5 is an annular elastic plate integrally formed of a metal material, arched from both sides of the retaining portion 503 and protruding at the outer end to form the second limiting portion 501.

As shown in FIG. 7, the first limiting portion 401 has an inclined guide surface 405. The inclined guide surface 405 is configured to form a guide effect on the second limiting portion 501 along the output wheel 4 in a direction from the switching-off position to the switching-on position. The inner wall of the housing 1 is provided with a limiting recess 101 corresponding to the retaining portion 503. The retaining portion 503 is engaged in the limiting recess 101. The inclined guide surface 405 facilitates the return of the limiting mechanism 5 when in the switching-on position.

The second pushing portion 602 is the end of the linking member 601. The linking member 601 passes through the linking groove 402, and its end keeps in contact with the pushing slope 506 in the rotation path of the input wheel 6.

The second energy storage mechanism 8 is a spring. Two ends of the spring abut against the linking member 601 and the output wheel 4, respectively.

The output wheel 4 has an annular groove 406 and a first limiting groove 407 communicating with the annular groove 406. The second energy storage mechanism 8 is disposed in the annular groove 406. One end of the second energy storage mechanism 8 is secured in the first limiting groove 407, and the other end of the second energy storage mechanism 8 is secured in a second limiting groove 408 to cooperate with the linking member 601.

The first energy storage mechanism 7 is a spring. Two ends of the spring are connected to the input wheel 6 and the housing 1, respectively.

The output wheel 4 may be locked and unlocked at its edge and other portion.

The retaining portion 503 may be connected by means of adhesive or a bolt. In this embodiment, the limiting mechanism is interposed between the inner wall of the housing and the output wheel 4, and the limiting mechanism itself has a certain elasticity, so the pushing force of the output wheel 4 and the second pushing portion 602 against the limiting mechanism enables the retaining portion 503 to be retained in the limiting recess 101 well, which facilitates the assembly.

Figure 11:
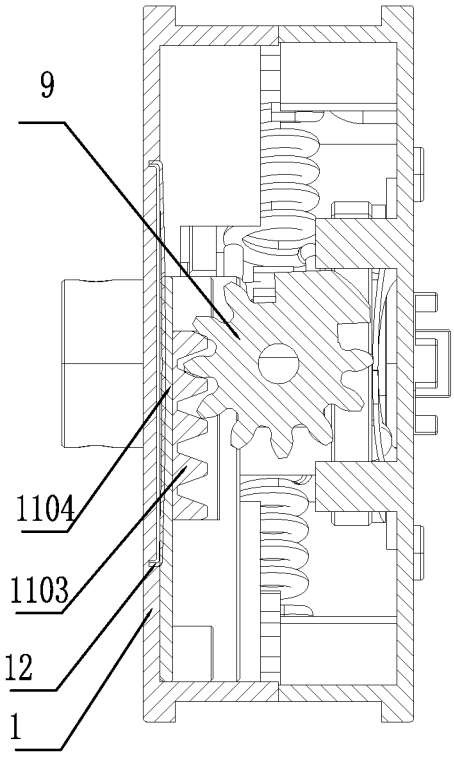
FIG. 11 is a sectional view taken along line C-C of FIG. 1.
Figure 12:
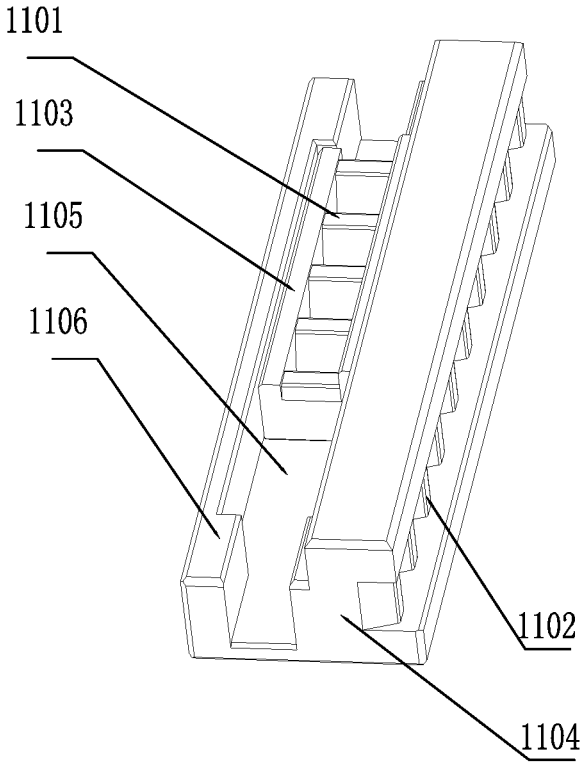
FIG. 12 is a schematic view of the transmission mechanism.
Figure 13:
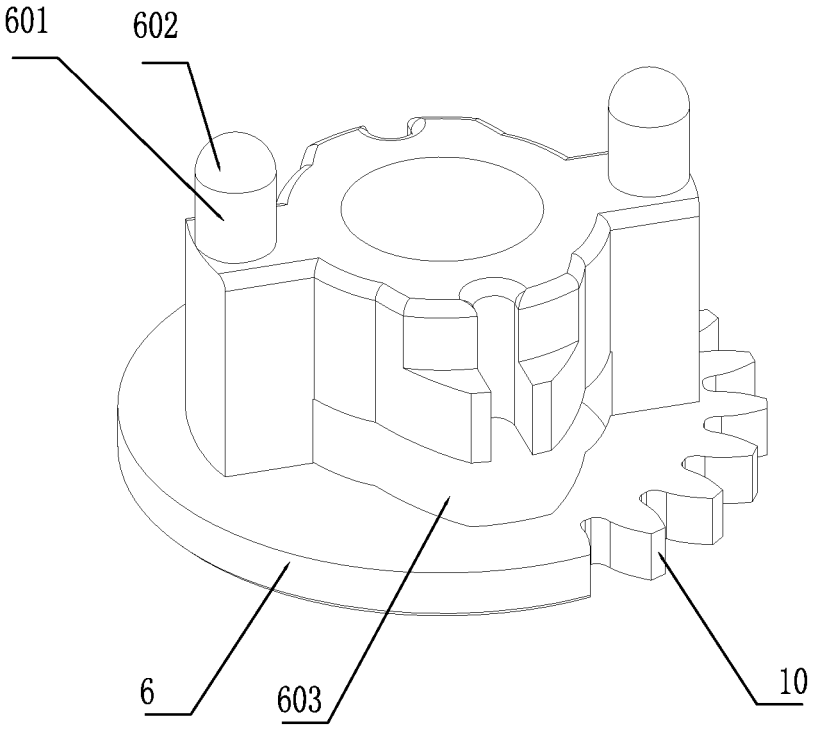
FIG. 13 is a schematic view of the input wheel.
Figure 14:
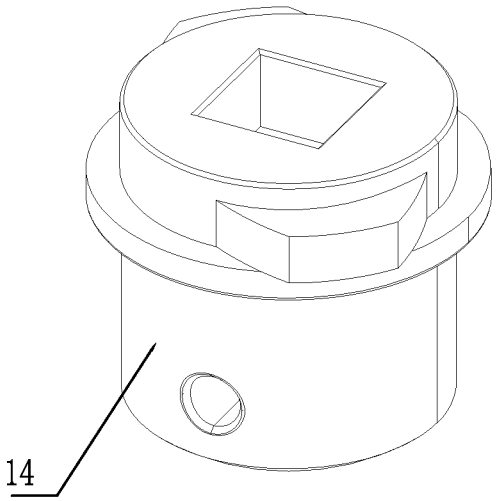
FIG. 14 is a schematic view of the second input shaft.
Figure 15:
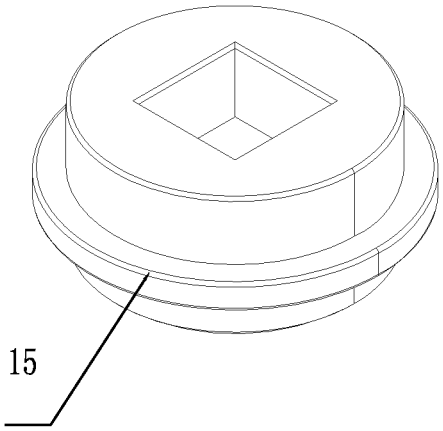
FIG. 15 is a schematic view of the second output shaft.

As shown in FIGS. 11-13, the first input shaft 2 is provided with a coaxial first gear 9 that is linked circumferentially. The input wheel 6 is provided with a coaxial second gear 10 that is linked circumferentially. The first gear 9 is perpendicular to the second gear 10. A transmission mechanism 11 is provided between the first gear 9 and the second gear 10. The transmission mechanism 11 has first teeth 1101 meshing with the first gear 9 and second teeth 1102 meshing with the second gear 10. The transmission mechanism 11 enables the second gear 10 to rotate in at least part of the rotation path of the first gear 9. With this structure, the transmission is more stable and accurate.

The transmission mechanism 11 includes a first rack 1103 and a second rack 1104. The second rack 1104 is provided with a first slide groove 1105 corresponding to the first rack 1103. The first rack 1103 is located in the first slide groove 1105 to slide linearly and cooperate with the second rack 1104. The first teeth 1101 are disposed on the first rack 1103. The second teeth 1102 are disposed on the second rack 1104. Two ends of the first slide groove 1105 are provided with stoppers 1106 for blocking the first rack 1103.

The inner wall of the housing 1 is provided with a second slide groove 102 corresponding to the transmission mechanism 11. The transmission mechanism 11 is located in the second slide groove 102 to slide linearly in the housing 1.

When an operating handle 13 is rotated, the first rack 1103 is first driven to slide in the first slide groove 1105. When the first rack 1103 is in contact with the stopper 1106 at one end, the first rack 1103 drives the second rack 1104 to slide in the second slide groove 102, thereby rotating the second gear 10 and the input wheel 6. Moreover, a metal elastic sheet 12 is embedded in the second slide groove 102 under the transmission mechanism 11. The metal sheet 12 arches to provide a pushing force to the transmission mechanism 11 toward the first gear 9. Through the above linking design, the first gear 9 and the first teeth 1101 are in mesh better and reliably. In addition, the friction coefficient between the transmission mechanism and the second slide groove 102 can be reduced to improve the mechanical life greatly.

The input wheel 6 is formed with a receiving hole 603. According to different working conditions, a second input shaft 14 circumferentially linked with the input wheel 6 is provided in the receiving hole 603 by plug-in connection for adjusting the operation position. The second input shaft 14 may be replaced with the second output shaft 15 linked with the first output shaft 3 to form an operating structure with dual output ends.

Figure 16:
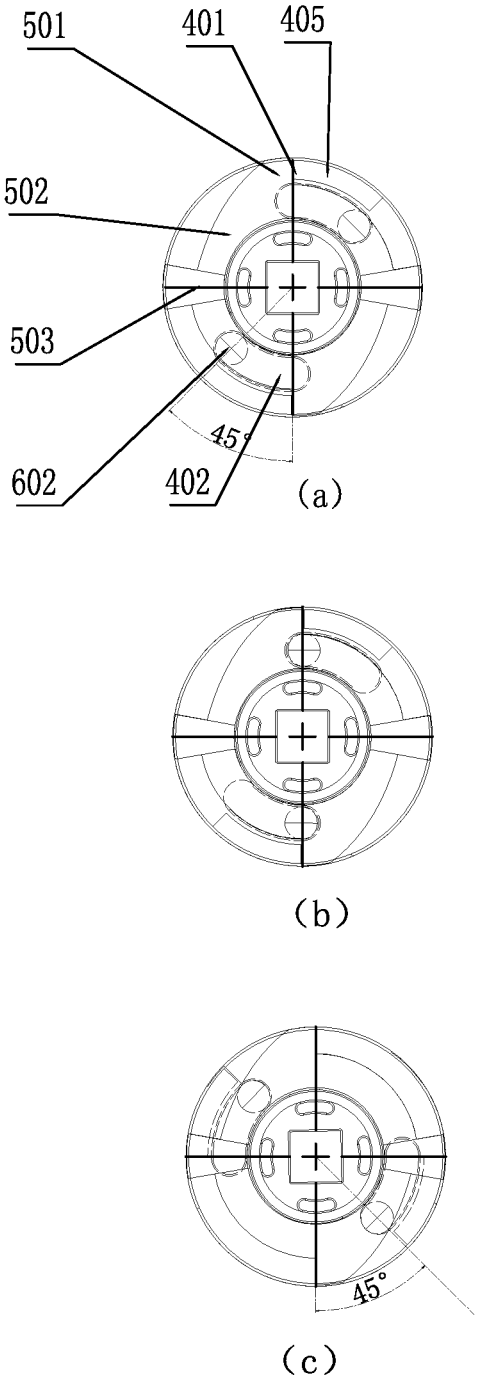
FIG. 16 is a schematic view showing that the second pushing portion, the output wheel and the limiting mechanism are rotated along with the input shaft, (a) in a switching-on state; (b) the first energy storage mechanism and the second energy storage mechanism are in an energy storage state and the input wheel is rotated 45° from the switching-on position to the switching-off position, (c) the first energy storage mechanism and the second energy storage mechanism are in an energy release state, the input wheel and the output wheel are linked to rotate from the switching-on position to the switching-off position, and the rotation angle is preferably 90°.

As shown in FIG. 16, taking the operating mechanism with a rotation angle of 90° as an example, the input shaft is rotated from the switching-on position to the switching-off position and then to the switching-on position again, showing the change of the positional relationship among the second pushing portion, the output wheel and the limiting mechanism. As shown in FIG. 16(*a*), in the switching-on position, the first pushing portion 502 of the limiting mechanism 5 is blocked at one side of the first limiting portion 401 (stepped portion) of the output wheel 4, so that the output wheel cannot rotate. As shown in FIG. 16(*b*), the operating mechanism is rotated 45° counterclockwise from the switching-on position to the switching-off position, the first energy storage mechanism 7 completes energy storage, the second energy storage mechanism 8 completes energy storage, and the first pushing portion 502 is pushed away from the side of the first limiting portion 401 (stepped portion) by the second pushing portion 602. At the same time, the linking member 601 is in contact with the linking surface 403, the first energy storage mechanism 7 releases energy to push the output wheel 4 to rotate counterclockwise, and the second energy storage mechanism 8 releases energy to help the output wheel 4 rotate counterclockwise. As shown in FIG. 16(*c*), when in the switching-off is completed, the limiting mechanism 5 abuts against the inclined guide surface 405.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual energy storage operating mechanism of an isolating switch, comprising:

a housing, a first input shaft and a first output shaft being rotatably disposed in the housing, at least one end of the first output shaft extending out of the housing as an output end linked with the isolating switch, at least one end of the first input shaft extending out of the housing as an operating end;

an input wheel, an output wheel and a limiting mechanism being provided in the housing, the input wheel being coaxial with the first output shaft, the output wheel being coaxial with the first output shaft and linked circumferentially, the limiting mechanism having at least one elastic portion and being locked circumferentially;

the output wheel having a first limiting portion and a linking groove, the limiting mechanism having a second limiting portion and a first pushing portion with a pushing slope;

the input wheel including a linking member partially located in the linking groove and a second pushing portion that cooperates with the first pushing portion, two ends of the linking groove being formed with linking surfaces for mating with the linking member;

the first input shaft driving the input wheel to rotate in at least part of a rotation path of the first input shaft, the second pushing portion interacting with the elastic portion of the limiting mechanism, in a rotation path of the input wheel, the second pushing portion being in contact with the pushing slope so that the limiting mechanism has a first position where the second limiting portion is engaged with the first limiting portion for the output wheel to be locked circumferentially and a second position where the second limiting portion is disengaged from the first limiting portion for the output wheel to be unlocked in a rotatable state;

a first energy storage mechanism being provided between the input wheel and the housing;

a second energy storage mechanism being provided between the input wheel and the output wheel or the first output shaft;

in the rotation path of the first input shaft from a switching-on position to a switching-off position, the first energy storage mechanism having an energy storage state and an energy release state, wherein when the first energy storage mechanism is in the energy storage state, the linking member slides in the linking groove, the limiting mechanism is in the first position, and the second energy storage mechanism is in an energy storage state; when the first energy storage mechanism is in the energy release state, the linking member abuts against the linking surface, the limiting mechanism is in the second position, and the second energy storage mechanism is in an energy release state.

2. The dual energy storage operating mechanism of the isolating switch as claimed in claim 1, wherein the limiting mechanism is disposed between the output wheel and an inner wall of the housing.

3. The dual energy storage operating mechanism of the isolating switch as claimed in claim 2, wherein the limiting mechanism further has a retaining portion, the second limiting portion, the first pushing portion and the retaining portion are connected in sequence, the retaining portion is connected to the inner wall of the housing, the first limiting portion is a raised stepped portion, the second limiting portion abuts against the first limiting portion, the first pushing portion is obliquely disposed between the inner wall of the housing and the output wheel, and the first pushing portion is made of an elastic material.

4. The dual energy storage operating mechanism of the isolating switch as claimed in claim 3, wherein the limiting mechanism includes two retaining portions that are arranged symmetrically relative to an axis of the first output shaft, two sides of the retaining portions extend outwardly and obliquely toward the output wheel to form two arc-shaped first pushing portions, each of the first pushing portions protrudes close to an outer end of the output wheel to form the second limiting portion, the input wheel is provided with two second pushing portions that are arranged symmetrically relative to the axis, the output wheel is provided with two first limiting portions that are arranged symmetrically relative to the axis.

5. The dual energy storage operating mechanism of the isolating switch as claimed in claim 3 or 4, wherein the first limiting portion has an inclined guide surface, and the inclined guide surface is configured to form a guide effect on the second limiting portion along the output wheel in a direction from the switching-off position to the switching-on position.

6. The dual energy storage operating mechanism of the isolating switch as claimed in claim 3 or 4, wherein the inner wall of the housing is provided with a limiting recess corresponding to the retaining portion, and the retaining portion is engaged in the limiting recess.

7. The dual energy storage operating mechanism of the isolating switch as claimed in claim 3 or 4, wherein the limiting mechanism is an annular elastic plate integrally formed of a metal material.

8. The dual energy storage operating mechanism of the isolating switch as claimed in any one of claims 2-4, wherein the second pushing portion is an end of the linking member, the linking member passes through the linking groove, and the end of the linking member keeps in contact with the pushing slope in the rotation path of the input wheel.

9. The dual energy storage operating mechanism of the isolating switch as claimed in claim 8, wherein the second energy storage mechanism is a spring, and two ends of the spring abut against the linking member and the output wheel, respectively.

10. The dual energy storage operating mechanism of the isolating switch as claimed in claim 9, wherein the output wheel has an annular groove and a first limiting groove communicating with the annular groove, the second energy storage mechanism is disposed in the annular groove, one end of the second energy storage mechanism is secured in the first limiting groove, and another end of the second energy storage mechanism is secured in a second limiting groove to cooperate with the linking member.

11. The dual energy storage operating mechanism of the isolating switch as claimed in claim 1, wherein the first energy storage mechanism is a spring, and two ends of the spring are connected to the input wheel and the housing, respectively.

12. The dual energy storage operating mechanism of the isolating switch as claimed in claim 1, wherein the first input shaft is provided with a coaxial first gear that is linked circumferentially, the input wheel is provided with a coaxial second gear that is linked circumferentially, the first gear is perpendicular to the second gear, a transmission mechanism is provided between the first gear and the second gear, the transmission mechanism has first teeth meshing with the first gear and second teeth meshing with the second gear, and the transmission mechanism enables the second gear to rotate in at least part of a rotation path of the first gear.

13. The dual energy storage operating mechanism of the isolating switch as claimed in claim 12, wherein the transmission mechanism includes a first rack and a second rack, the second rack is provided with a first slide groove corresponding to the first rack, the first rack is located in the first slide groove to slide linearly and cooperate with the second rack, the first teeth are disposed on the first rack, the second teeth are disposed on the second rack, and two ends of the first slide groove are provided with stoppers for blocking the first rack.

14. The dual energy storage operating mechanism of the isolating switch as claimed in claim 12 or 13, wherein the inner wall of the housing is provided with a second slide groove corresponding to the transmission mechanism, and the transmission mechanism is located in the second slide groove to slide linearly in the housing.

15. The dual energy storage operating mechanism of the isolating switch as claimed in claim 14, wherein a metal elastic sheet is embedded in the second slide groove under the transmission mechanism, and the metal sheet arches to provide a pushing force to the transmission mechanism toward the first gear.

* * * * *